US008511321B2

(12) United States Patent
Sanz et al.

(10) Patent No.: US 8,511,321 B2
(45) Date of Patent: Aug. 20, 2013

(54) COMB FOR TREATING PEDICULOSIS

(76) Inventors: Juan Martin Sanz, Buenos Aires (AR); Jorge Reinaldo Burchakchi, Buenos Aires (AR)

( * ) Notice: Subject to any disclaimer, the term of this patent is extended or adjusted under 35 U.S.C. 154(b) by 0 days.

(21) Appl. No.: 13/511,357

(22) PCT Filed: Nov. 23, 2009

(86) PCT No.: PCT/ES2009/000541

§ 371 (c)(1),
(2), (4) Date: Jun. 7, 2012

(87) PCT Pub. No.: WO2011/061354

PCT Pub. Date: May 26, 2011

(65) Prior Publication Data

US 2012/0234342 A1 Sep. 20, 2012

(51) Int. Cl.
*A45D 24/00* (2006.01)

(52) U.S. Cl.
USPC ..... 132/219; 132/200

(58) Field of Classification Search
USPC ..... 132/219, 120, 121, 125, 200, 163
See application file for complete search history.

(56) References Cited

U.S. PATENT DOCUMENTS

| | | | | |
|---|---|---|---|---|
| 4,502,498 | A * | 3/1985 | Saferstein et al. | 132/137 |
| 5,694,953 | A * | 12/1997 | Stephan et al. | 132/160 |
| 5,873,374 | A * | 2/1999 | Sanz | 132/125 |
| 2002/0078972 | A1 | 6/2002 | Levandovsky et al. | |

FOREIGN PATENT DOCUMENTS

| | | | |
|---|---|---|---|
| ES | 2199392 | T3 | 2/2004 |
| WO | 0008969 | A2 | 2/2000 |
| WO | 2006097750 | A1 | 9/2006 |
| WO | 2008022387 | A1 | 2/2008 |

OTHER PUBLICATIONS

International Search Report issued on Mar. 1, 2010 for International Application No. PCT/ES2009/000541.

* cited by examiner

*Primary Examiner* — Rachel Steitz
(74) *Attorney, Agent, or Firm* — Knobbe, Martens, Olson & Bear, LLP

(57) ABSTRACT

A comb for treating pediculosis id provided. The comb may include a handle and a plurality of teeth, each provided with successive ridges or grooves intended for trapping and removing nits and lice from the hair, wherein each ridge or groove is flanked by a raised edge on at least one of the sides thereof.

11 Claims, 4 Drawing Sheets

COMB FOR TREATING PEDICULOSIS

RELATED APPLICATIONS

This application is a U.S. National Phase of International Application No. PCT/ES2009/000541, filed Nov. 23, 2010, designating the U.S., and published in Spanish as WO 2011/061354 on May 26, 2011, the disclosures of which are hereby expressly incorporated by reference in their entirety and are hereby expressly made a portion of this application.

FIELD OF THE INVENTION

The present invention relates to the field of devices used for the treatment of lice, in order to remove nits or lice eggs which cling to hair, and more particularly the invention relates to a new comb for the treatment of pediculosis, which allows to remove nits and head lice more effectively than known combs and devices and without damaging the hair.

BACKGROUND

Pediculosis is a problem that affects countless individuals in all kinds of communities, and constitutes an obstacle in the student population, since school-age children acquire it easily when in contact with schoolmates at the educational institution they attend.

Head lice settle in the hair, where they lay down the known nits, i.e. eggs of *Pedeculus humanus, Phtirius pubis* and similar species, commonly known as lice.

Many chemical compounds have been developed for the treatment of this infection, as well as a number of combs intended to treat it by removing lice and nits, thus causing no side effects, as is the case with the application of chemicals. There are various comb designs comprising a handle to which multiple teeth or steel wires are attached, the separation of which is studied to allow just a hair to pass tightly between adjacent teeth, so that anything adhered on it, particularly a nit, is retained between the teeth of the comb. Thus, passing the comb throughout the patient's hair allows to achieve the removal of as many nits as possible.

One of the combs that has most effectively achieved the goal of removing nits more successfully is the one disclosed in Argentine Patent AR 03275 B1, and its American equivalent U.S. Pat. No. 5,873,374, both owned by the present owners and which describe, as more specifically defined in the claims, a cleaning comb with needles that have a ruggedness on its peripheral surface, comprising a handle and a plurality of—preferably steel—teeth, wires or needles, each needle having an end attaching to a handle, an attacking end and a peripheral surface, and the attacking end of each needle having a sharp and rounded tip. According to the concepts of these patents, the novelty of this comb as regards prior art is that the peripheral surface of each needle is provided with a ruggedness designed to catch and drag nits attached to the hair. The comb also has other features, such as the distance between adjacent needles, which is between 50 μm and 100 μm, each needle having a total length in the range of 40 to 80 mm and a useful length, outside the handle, in the range of 20 to 60 mm.

The ruggedness feature referred to in Argentine Patent AR 03275 B1, as well as in its U.S. counterpart, is preferably based on the provision of a helical groove having, for instance, a way narrower than 4 mm. This ruggedness can be also formed by circumferential grooves with a distance from each other between 0.5 and 3 mm, and these channels may be less than 0.2 mm deep.

Additionally, this known comb has other features, such as the fact that it is made of steel, the number of needles is between 10 and 100, more precisely 33 needles, and that the attacking edges of the needles form together a curved edge.

Gutters or grooves in both Argentine Patent AR 03275 B1 and its equivalent American U.S. Pat. No. 5,873,374, as shown and protected also in both patents, are obtained through machining, but they are particularly obtained by means of cutting tools. In fact, both, in the Argentine Patent as well as in its American equivalent, it is emphasized that the gutters, grooves or ridges are obtained by subjecting the teeth or needles to the action of a cutting tool which operates on the teeth's surface under the action of a given force.

Although it must be admitted that these gutters or grooves have proven quite effective in removing nits, it has also been found over the years in use that these gutters, grooves or ridges had at least two flaws that could be corrected. One of them is based on the fact that gutters or grooves formed through cutting or removal of material result in a microscopic surface that is too rough and abrasive, effective for dragging nits but somewhat harmful to human hair.

A second aspect regarding the possibility of having the comb under Argentine Patent AR 03275 B1 further improved has to do with the fact that, while the provision of gutters or grooves has meant an improvement in nits' retention and dragging, some nits did succeed in eluding these gutters, sliding through them and not being held between the teeth. The purpose of these grooves is to provide sharp edges to interrupt the tooth's smooth surface, so as to suddenly change its geometry and set there a trap for the nit. However, it has been observed along time that this concept could be improved.

On account of the above stated, the inventors hereof set out to improve the functional aspects of the teeth of a comb for the treatment of head lice in order to achieve a removal even more efficient and effective than that obtained by known combs in the art.

SUMMARY

Therefore, one of the purposes of this invention is to provide a new comb for the treatment of head lice which comprises needles, teeth or wires provided with surface means capable of retaining, catching and dragging nits, dirt and lice without damaging hair.

Still another purpose of this invention is to provide a new comb for the treatment of head lice which ensures effective removal of nits and foreign matter adhered to the hair not only by means of grooves or gutters made in the comb teeth or needles, but also through abrupt changes or reductions in the separation between teeth.

Still another purpose of this invention is to provide a comb for the treatment of head lice which comprises a grip handle and a plurality of teeth, each provided with successive grooves or valleys intended to trap and drag lice and nits present on the hair, and each groove or valley being flanked by a raised flange on at least one of its sides.

It is furthermore another purpose of this invention to provide a comb for the treatment of head lice of the type comprising a grip handle from which multiple teeth emerge, which are provided with rough means for retention and dragging of lice and nits present on the hair. These rough means are formed by multiple and successive grooves or valleys defined on the surface of at least one longitudinal segment of each of said teeth, and each of said grooves or valleys are flanked on at least one of its sides by a raised flange that tops said surface of such at least one longitudinal segment of each tooth.

Still another purpose of this invention is to provide a method for forming grooves and raised flanges on the teeth of a comb for the treatment of head lice, which comprises a handle and a plurality of—preferably metal—teeth or pins or wires, which method comprises the stage of subjecting each of the comb teeth to the action of a laminating tool that forms said grooves through pressure, exerting this pressure as a force vector slanted with respect to said surface of the tooth, so as to move the material adjacent to the groove to at least one side of the groove, thus forming such flange at least said at one side of the groove.

BRIEF DESCRIPTION OF THE DRAWINGS

For the sake of clarity and understanding of the subject matter of this invention, it has been illustrated in several figures, in which the invention has been shown in one of the preferred forms of representation, just by way of example, wherein.

DETAILED DESCRIPTION OF CERTAIN INVENTIVE ASPECTS

Figure 1:
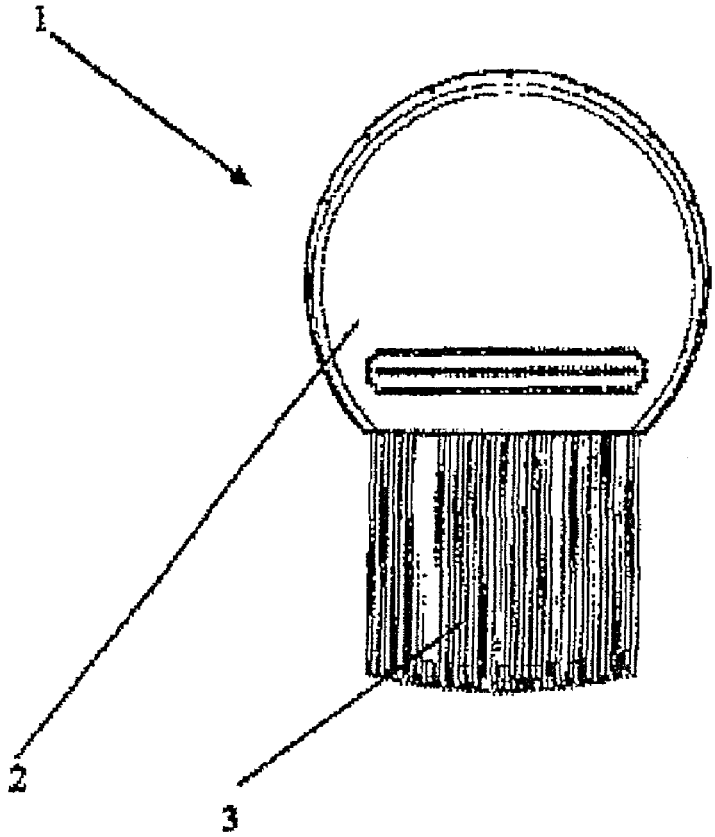
FIG. 1 shows a front elevation view of a comb for the treatment of head lice in accordance with the present invention.
Figure 2:
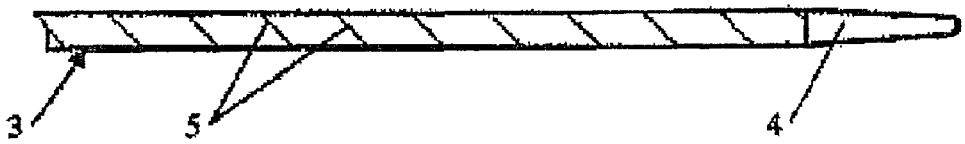
FIG. 2 shows a plan view, partially in section, of a tooth of the comb in FIG. 1, with helical grooves.
Figure 3:
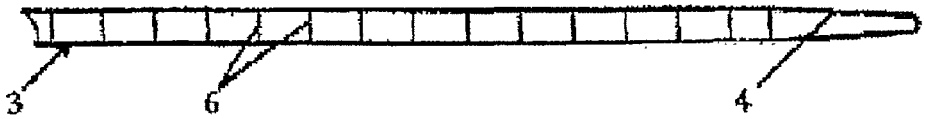
FIG. 3 shows a plan view, partially in section, of a tooth of the comb in FIG. 1, with circumferential grooves.
Figure 4:
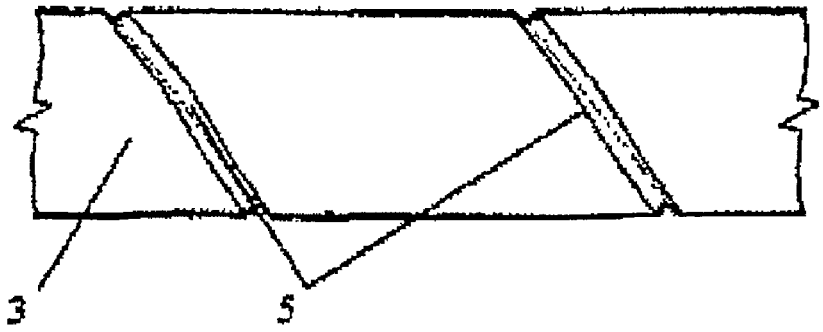
FIG. 4 shows a more detailed view of a portion of tooth of the comb in FIGS. 1 and 2.

Referring now to the figures, we can see that the invention is a comb for the treatment of head lice, indicated by general reference 1, of the type comprising a grip handle 2 within which a plurality of teeth are mounted 3, extending from the handle 2 in parallel with each other and maintaining a distance of, for example, 50 μπ and 100 μπι, a distance which has already proven to be efficient in the comb under Argentine Patent AR 03275 B1 by the same inventors and holders of the present invention. Likewise, the teeth or needles can have a total length in the range of 40 to 80 mm and a useful length, outside the handle, in the range of 20 to 60 mm. In the aforementioned patent, teeth or needles were provided with rough means for retaining and dragging nits and lice present in the hair. These means, among other alternatives, disclosed the possibility of being formed by multiple and successive grooves or valleys that are defined on the surface of at least one longitudinal segment of each of said teeth. The ends 4 of the needles or teeth 3 are preferably finished in a mildly conical shape to prevent damage to the scalp.

The present invention, as illustrated in FIGS. 2 to 6, has also chosen to define a pattern of grooves or valleys either helical 5 or circumferential 6, along at least one longitudinal segment of each of the teeth; however it is worth noting that the concepts of the invention are not bound to these two designs, but can be applied to any pattern or design of grooves, furrows or valleys, provided these are intended to form a gripping and dragging trap for nits, lice and foreign matter clinging to the hair of patients or users.

Figure 6:
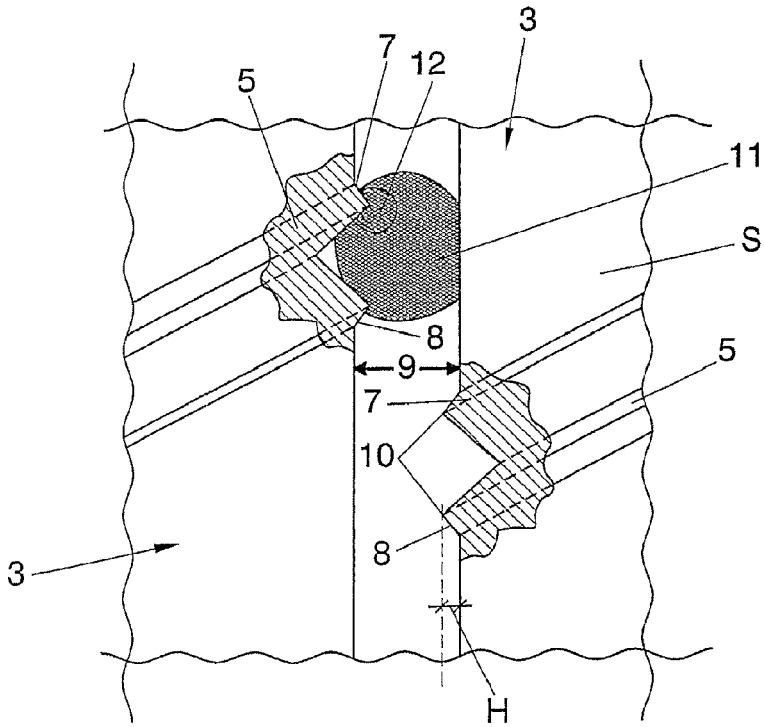
FIG. 6 shows a sectional view of the detail enclosed in the circle in FIG. 5.
Figure 7:
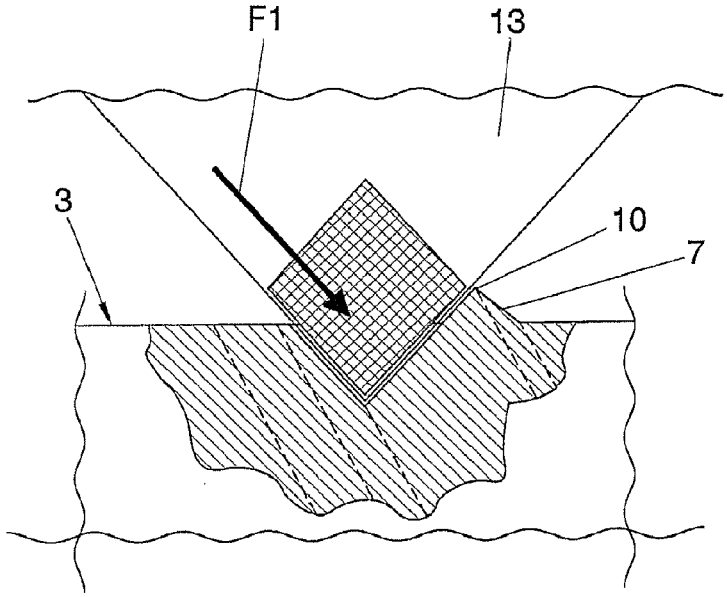
FIG. 7 shows a partially sectioned view of a pressure tool that generates a groove on the surface of the comb teeth, leaving a raised flange only on one side of the groove.
Figure 8:
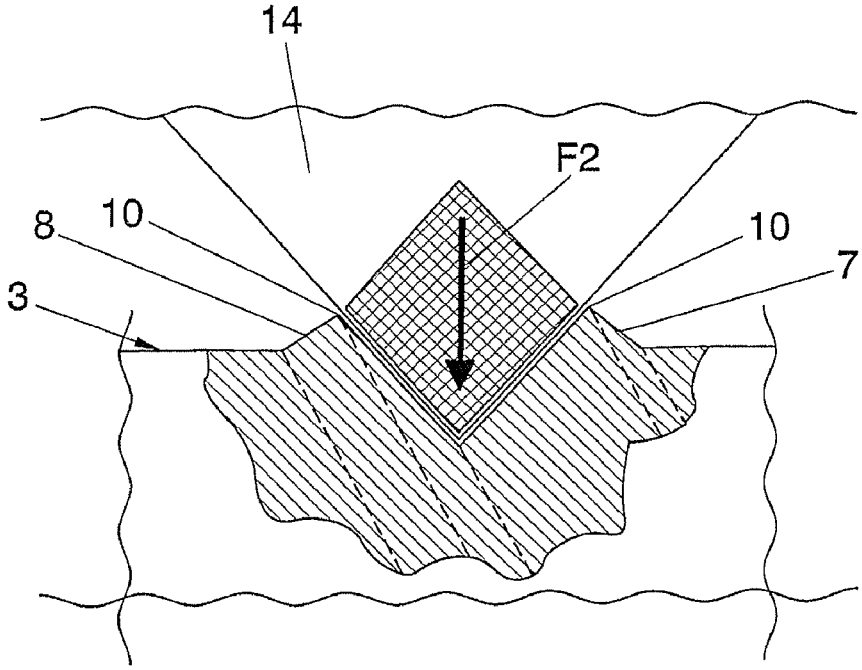
FIG. 8 shows a partially sectioned view of a pressure tool that generates a groove on the surface of the comb teeth, leaving a raised flange on each side of the groove.

More precisely according to the invention, and as best illustrated in FIGS. 6 to 8, each helical 5 or circumferential 6 groove or valley has, in at least one of its sides, an elevated flange 7 above the cylindrical and generally smooth surface of the tooth 3. The teeth will be separated from one another by a distance 9 which size will be in accordance with the design conditions, and within the values already mentioned above. Preferably, two flanges will be provided 7 and 8, one on each side of the groove 5 or 6, so as to flank both sides of the groove; however, it should be noted that a single flange is also capable of achieving the desired effects. Furthermore, the flanges 7, 8 may have a top 10, which may define an acute or mildly rounded edge, depending on the desired design, the material used, etc.

The teeth may be spaced apart by a distance of between, for instance, 50 μια and 100 μπι, and said raised flange extends preferably between 0.005 mm and 0.04 mm above said tooth surface "S", and more preferably at a maximum distance of 0.01 mm. These circumferential grooves may be spaced apart by a distance of between 0.5 mm and 4 mm, and said helical grooves may have a helical passage of between 0.5 mm and 4 mm. In either case, helical or circumferential, groove spacing should preferably be not less than 0.2 mm. In the case of helical grooves, the helix pitch will be preferably right, as a regular screw, i.e. if the screw rotates clockwise, it would advance.

Figure 5:
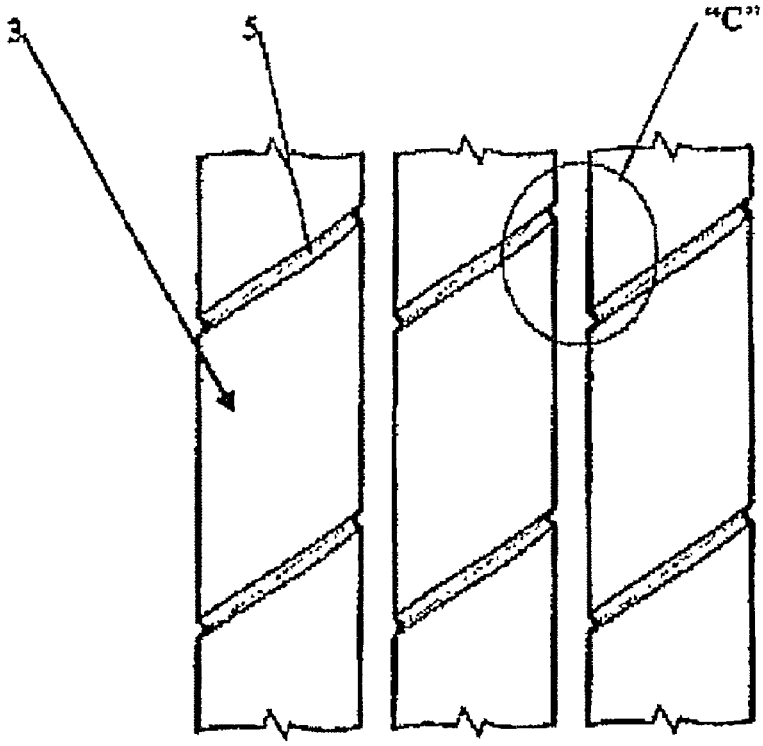
FIG. 5 shows a front elevation view of three teeth of the comb in FIGS. 1 and 2, more in detail.

Furthermore, the grooves of adjacent teeth may be arranged so that the raised flanges 7 and 8 of adjacent teeth are out of phase with each other, as illustrated in FIGS. 5 and 6, or face each other. In either case, the distance between two adjacent teeth 9 will be diminished and hence restrict the passage of a hair 11 holding a nit or foreign matter 12.

One way to achieve the formation of the raised flanges 7, 8, and unlike known procedures, the present invention provides a method for the formation of grooves 5, 6 and raised flanges 7, 8 on comb 1 teeth 3. In fact, whereas the ruggedness and grooves on comb teeth of the prior art, including the one under Argentine Patent AR 03275 B1, are achieved through the use of cutting tools for machining the tooth surface, which results in grooves that are very rough and abrasive to the hair, the present invention employs a different method that successfully solves two problems of known combs. One problem is the groove abrasiveness and the other is the lack of sufficient texture on the teeth as to more effectively trap nits.

According to the invention, grooves are made using lamination techniques rather than cutting, and more particularly, a single stage of deformation of the tooth material is performed, which consists in subjecting each of the comb teeth to the action of a laminating tool 13 that forms such grooves 5, 6 by pressure. Said pressure is exerted according to a force vector Fl that can be slanted with respect to said tooth surface "S", as illustrated in FIG. 7, so as to move the material adjacent to the groove to at least one of its sides, forming said flange 7 on at least that side of the groove.

Alternatively, the method of the invention may employ a laminating tool 14, as shown in FIG. 8, which exerts a force F2 perpendicular to the tooth 3 surface, so as to move the material adjacent to the groove towards both sides of the groove, thus forming said flanges 7, 8 on both sides of the groove.

This manufacturing process is a cold rolling and the groove or slot 5, for instance, can be done by rotating the tool around the wire as it passes through the tool. Indeed, the tool 13 or 14 can be single or multiple.

The present invention represents an advance over the prior art. For instance, Argentine Patent AR 03275 B1 has been successful in having the nit fall into a slit at 90 degrees of its motion and be caught as long as the nit entered the furrow on the tooth. With the present invention, having one or two flanges 7, 8, it is then possible to extend the most aggressive area for nits—flanges and groove—, and also to generate a protrusion that offers an additional trap. Now nits hit the flanges more often than they would fall into the furrow of the Patent by the same inventors.

Two effects are achieved with the flanges of the invention: increasing the probability of nits getting caught, as the roughened is larger. Now it extends rather along the generatrix of the cylinder, thus facilitating the encounter with the nits. The projecting rim, for instance at 90 degrees with respect to the nit movement, drags and/or breaks the nit in its path. By paying attention to the way these combs are passed through the head, it can be noted that the movement of the tooth, with its groove and flanges, with respect to the nits on the hair, has a component that is perpendicular to the tooth and another component in the direction of its axis. The combined motion of the nit, then, with respect to the groove is nearly at ninety degrees from its course. I.e., by passing the comb, the nits attached to the hair are engaged either with the flanges or with the groove.

FIG. 6 shows a longitudinal section of the tooth where we can see the contact profile and the nit attached to the hair that is pulled by the flanges and the groove. As indicated in this Figure, the height "H" of each flange 7, 8 would not exceed 0.04 mm.

The other aspect that improves the present invention is that, in the absence of swarf removal in the manufacturing process, the material of the tooth takes a plastic state under the lamination pressure, moves and is deposited on the edges, thus forming the flanges 7, 8. So, the internal groove surface thus obtained is non-abrasive while its raised flanges are very aggressive.

The rolling method used in the manufacturing process also improves tooth resistance to bending, which is an important variable in the effectiveness of the comb. This improvement is due to the fact that the resulting notch does not cut the fibers of the material as in the case of swarf removal.

What is claimed is:

1. A comb for the treatment of head lice of comprising a grip handle from which a plurality of teeth is projected, which are provided with rough area for the retention and dragging of lice and nits present on hair, wherein said rough area are formed by a plurality of successive grooves or valleys defined on a surface of at least one longitudinal segment of each of said teeth, wherein:

each of said grooves or valleys is flanked, in at least one of its sides, by a raised flange over said surface of such at least one longitudinal segment of each of the teeth.

2. A comb according to claim 1, wherein said teeth are spaced at a distance of between 0.05 mm and 0.1 mm, and said raised flange extends between 0.005 mm and 0.04 mm above said tooth surface.

3. A comb according to claim 2, wherein said grooves extend circumferentially around the tooth and are spaced apart at a distance of between 0.5 mm and 4 mm.

4. A comb according to claim 2, wherein said grooves extend in a helical manner around the tooth and the passage of said helix has a dimension of between 0.5 mm and 4 mm.

5. A comb according to claim 1, wherein each of said raised flanges has a sharp top edge.

6. A comb according to claim 1, wherein each of said raised flanges has a smoothly rounded top edge.

7. A comb according to claim 1, wherein the raised flanges of adjacent teeth are out of phase with each other.

8. A comb according to claim 1, wherein the raised flanges of adjacent teeth are facing each other.

9. A comb according to claim 1, wherein said raised flanges are present on both sides of each groove.

10. A method for forming grooves and raised flanges on the teeth of a comb according to claim 1, comprising:

subjecting each of the teeth of said comb to the action of a tool for pressure laminating to form said grooves, exerting such pressure as a force vector slanted with respect to said tooth surface, so as to move the material adjacent to the groove toward at least one side of the groove, thus forming said flange on at least said side of the groove.

11. A method according to claim 10, wherein said laminating tool exerts a force perpendicular to the surface of said tooth so as to move the material adjacent to the groove toward both sides of the groove, thus forming said flange on both sides of the groove.

* * * * *